US006882803B2

(12) United States Patent
Ashida et al.

(10) Patent No.: US 6,882,803 B2
(45) Date of Patent: Apr. 19, 2005

(54) METHOD OF AND APPARATUS FOR DETERMINING DEVELOPER LEVEL IN AN IMAGE FORMING APPARATUS AND TONER CARTRIDGE

(75) Inventors: Kenichi Ashida, Toyohashi (JP); Takuya Wada, Minamishitara (JP)

(73) Assignee: Minolta Co., Ltd., Osaka (JP)

( * ) Notice: Subject to any disclaimer, the term of this patent is extended or adjusted under 35 U.S.C. 154(b) by 17 days.

(21) Appl. No.: 10/601,586

(22) Filed: Jun. 24, 2003

(65) Prior Publication Data

US 2004/0001723 A1 Jan. 1, 2004

(30) Foreign Application Priority Data

Jun. 28, 2002 (JP) ..... 2002-189939

(51) Int. Cl.[7] ..... G03G 15/08
(52) U.S. Cl. ..... 399/27
(58) Field of Search ..... 399/27, 24, 258, 399/262

(56) References Cited

FOREIGN PATENT DOCUMENTS

| | | | | |
|---|---|---|---|---|
| JP | 1316765 | 12/1989 | | |
| JP | 06-22853 | 6/1994 | | |
| JP | 06-266232 | 9/1994 | | |
| JP | 07140776 A | * 6/1995 | ..... | G03G/15/08 |

* cited by examiner

*Primary Examiner*—Quana Grainger
(74) *Attorney, Agent, or Firm*—Morrison & Foerster LLP

(57) ABSTRACT

A toner cartridge for an image forming apparatus which can detect the remaining state of a developer even when the developer in the cartridge is biased by the rotation and stirring of a rotary conveyance body. A developer detector arranged outside the toner cartridge has a light projecting unit and a light receiving unit, and the toner cartridge has detection windows through which light projected from the light projecting unit is input and output. The optical axis of an optical path from the light projecting unit to the light receiving unit intersects the rotary shaft of the rotary conveyance body in the toner cartridge or becomes parallel to the moving direction of the developer. The remaining state of the developer is detected according to whether the optical path going from the light projecting unit to the light receiving unit is cut off or not.

21 Claims, 14 Drawing Sheets

METHOD OF AND APPARATUS FOR DETERMINING DEVELOPER LEVEL IN AN IMAGE FORMING APPARATUS AND TONER CARTRIDGE

This application is based on the patent application Ser. No. 2002-189939 field in Japan, the contents of which are hereby incorporated by reference.

BACKGROUND OF THE INVENTION

1. Field of the Invention

The present invention relates to an image forming apparatus such as an electrophotographic copying machine or printer and to a toner cartridge for supplying a developer, used in the same.

2. Prior Art

In a conventional image forming apparatus such as an electrophotographic copying machine or printer, a photosensitive body is uniformly charged, and an image is formed on the photosensitive body to form a latent image. The formed latent image is developed with toner to form a toner image which is then transferred to a recording medium or an intermediate transfer material to be further transferred to a recording medium and fixed on the recording medium to form an image.

The developing unit of the image forming apparatus comprises a developing roller and a developer storage chamber having a stirring and mixing unit. When a two-component developer is used, the developer which is prepared by mixing toner with a carrier (magnetic powder) under agitation in the developer storage chamber and is charged is contacted to the developing roller to form a developing brush. The above developing brush is contacted to a latent image formed on the photosensitive body to develop the latent image in order to form a toner image.

Since the toner which is reduced by carrying out development is supplied in this developing unit, the developer storage chamber is loaded with a toner cartridge. To supply the toner, the amount of the remaining toner must be detected. It is possible to know the time of supplying toner by detecting the amount of the remaining developer which is a mixture of toner and a carrier.

In an image forming apparatus which uses a one-component developer, as the amount of the developer is gradually reduced by carrying out development, the developer must be supplied as well.

To cope with this, a developer detector for detecting the amount of the remaining developer is installed in the developer storage chamber. There is suggested a developer detector which displays a warning to urge the supply of toner (developer in the case of a one-component system) or automatically supply toner when the amount of the remaining developer becomes a predetermined amount or less.

There is known a developer detector which comprises a light projecting unit and a light receiving unit in a developer storage chamber and detects the existence of a developer, making use of the fact that a light beam projected from the light projecting unit is cut off by the developer and not input into the light receiving unit when the developer is existent in an optical path from the light projecting unit to the light receiving unit (for example, Official Gazette of Japanese Patent Nos. 3143541 and 2820695).

There is also a developer detector in which a density sensor is installed in a developer storage chamber to automatically supply a developer based on the output signal of the density sensor (for example, Examined Utility Patent Publication No. Hei6-22853).

When the developer storage chamber is loaded with a toner cartridge, the developer is discharged toward the developer storage chamber while it is stirred by a conveyance unit placed in the toner cartridge. As the developer is discharged toward the developer storage chamber, the developer in the toner cartridge is biased. Therefore, the amount of the remaining developer cannot be detected accurately according to the position of the developer detector, thereby causing variations in detection result. The present invention is aimed to solve this problem.

Since the above-described developer storage chamber is part of the developing unit, the developer storage chamber will be referred to "developing unit" including the developer storage chamber in the following description.

SUMMARY OF THE INVENTION

It is the principal object of the present invention to provide a toner cartridge for an image forming apparatus, comprising a rotary conveyance body, which can detect the remaining state of a developer accurately by the rotation and agitation of the rotary conveyance body even when the developer in the cartridge is biased.

It is another object of the present invention to provide a toner cartridge for an image forming apparatus, comprising a rotary conveyance body, which can detect the remaining state of a developer accurately by the rotation and agitation of the rotary conveyance body even when the amount of the remaining developer in the cartridge is small.

It is still another object of the present invention to provide an image forming apparatus using a developing unit comprising a developer detector which can be loaded with the above toner cartridge and can detect the remaining state of a developer accurately or an image forming apparatus having a developer detector in its body.

Other objects of the present invention will become apparent from the following description with reference to the accompanying drawings.

DETAILED DESCRIPTION OF THE PREFERRED EMBODIMENTS

Preferred embodiments of the present invention will be described hereinunder. First to sixth embodiments of the present invention are toner cartridges for an image forming apparatus using a two-component developer. The toner cartridges can be used for an image forming apparatus using a one-component developer as well. Therefore, in the following description, it should be understood that a toner cartridge containing a one-component developer means a developer cartridge and that toner means a developer.

Figure 1:
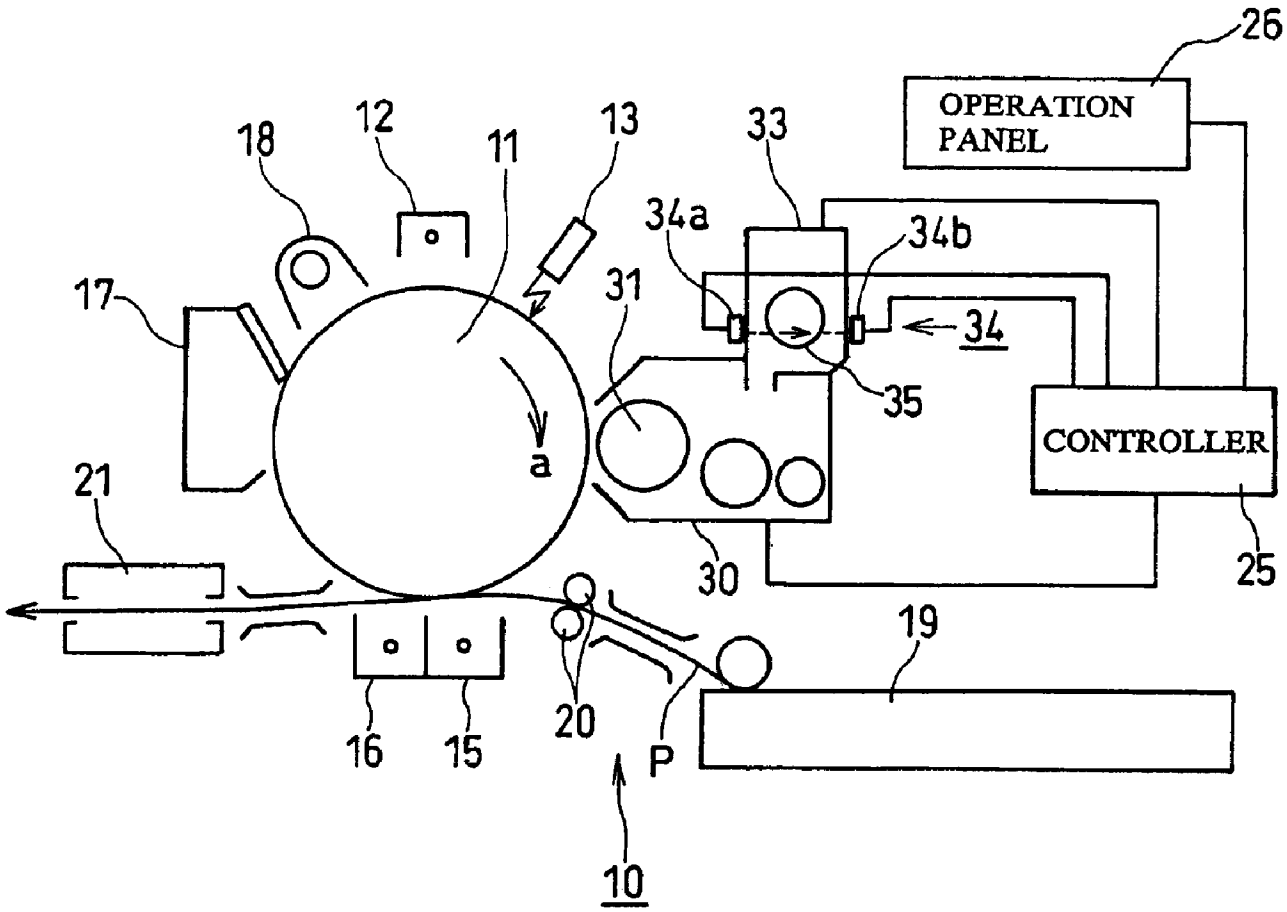
FIG. 1 is a front view showing the constitution of an image forming apparatus to which the present invention is applied.

A schematic description is first given of the constitution of an image forming apparatus to which the present invention is suitably applied. FIG. 1 is a front view of the image forming apparatus 10. An electrostatic charger 12, an exposure unit 13, a developing unit 30, a transfer charger 15, a separation charger 16, a cleaning unit 17 and an eraser 18 are arranged around a photosensitive body 11.

A paper feeding unit 19 which stores a recording medium P is arranged below the image forming apparatus 10, a pair of timing rollers 20 are placed in proximity to the photosensitive body 11 between the developing unit 30 and the transfer charger 15, and a fixing unit 21 is situated at a downstream in the conveying direction of the recording medium P of the separation charger 16.

The developing unit 30 has a developing roller 31 and a toner cartridge 33 for supplying toner which is detachably mounted to the developing unit 30.

The developing unit 30 comprises a toner detector 34 as developer detection means. The toner detector 34 comprises a light projecting unit 34*a* having light emitting elements and a light receiving unit 34*b* having light receiving elements, and the toner cartridge 33 is interposed between the light projecting unit 34*a* and the light receiving unit 34*b*.

The toner cartridge 33 is provided with detection windows through which a light beam for detecting toner projected from the toner detector 34 is input and output and a rotary conveyance member 35. This will be described in detail hereinafter.

The above image forming apparatus is just an example and is not limited to this constitution. The developing unit 30 may be detachably mounted to the image forming apparatus as a unit like a process cartridge. In the above embodiment, the toner cartridge 33 is detachably mounted to the developing unit 30 but may constitute a toner feeding unit together with the developing unit.

A brief description is subsequently given of the operation of the above image forming apparatus. The photosensitive body 11 which turns at a fixed speed in a direction shown by an arrow "a" is uniformly charged by the electrostatic charger 12. A laser beam modulated by an image signal output from an unshown image reader, facsimile or personal computer is projected from the exposure unit 13 onto the photosensitive body 11 to form a latent image on the photosensitive body 11. The latent image on the photosensitive body 11 is developed with toner loaded into the developing unit 30 to form a toner image on the photosensitive body 11.

Meanwhile, the recording medium P is carried from the paper feeding unit 19 which stores the recording medium P to a pair of timing rollers 20 and suspended. The turning of the timing rollers 20 is started when the toner image on the photosensitive body 11 comes to the transfer position, and the recording medium P is carried to the transfer position. At the transfer position, the toner image on the photosensitive body 11 is transferred to the recording medium P by the function of the transfer charger 15, and further the recording medium P is separated from the photosensitive body 11 by the function of the separation charger 16.

Thereafter, the toner image on the recording medium P is fixed by the fixing unit 21 and discharged. Further, the toner remaining on the surface of the photosensitive body 11 is removed by the cleaning unit 17, and the residual charge on the surface of the photosensitive body 11 is removed by the eraser 18, thereby completing the image forming operation.

The existence of the toner in the toner cartridge 33 is detected by the toner detector 34 under the control of a controller 25 during the operation of the image forming apparatus. That is, a light beam projected from the light projecting unit 34*a* is let pass through the inside of the toner cartridge 33 and received by the light receiving unit 34*b* in order to detect the existence of toner based on whether the light beam is cut off by the existence of the toner in the optical path or not. The detection result is displayed on an operation panel 26 by showing a message, for example, "The toner is running short. Please prepare a new toner cartridge". It is needless to say that this may be notified by a lamp or other display means.

There are a plurality of examples of the above toner cartridge 33. They will be described hereinunder.

First Embodiment

Figure 2:
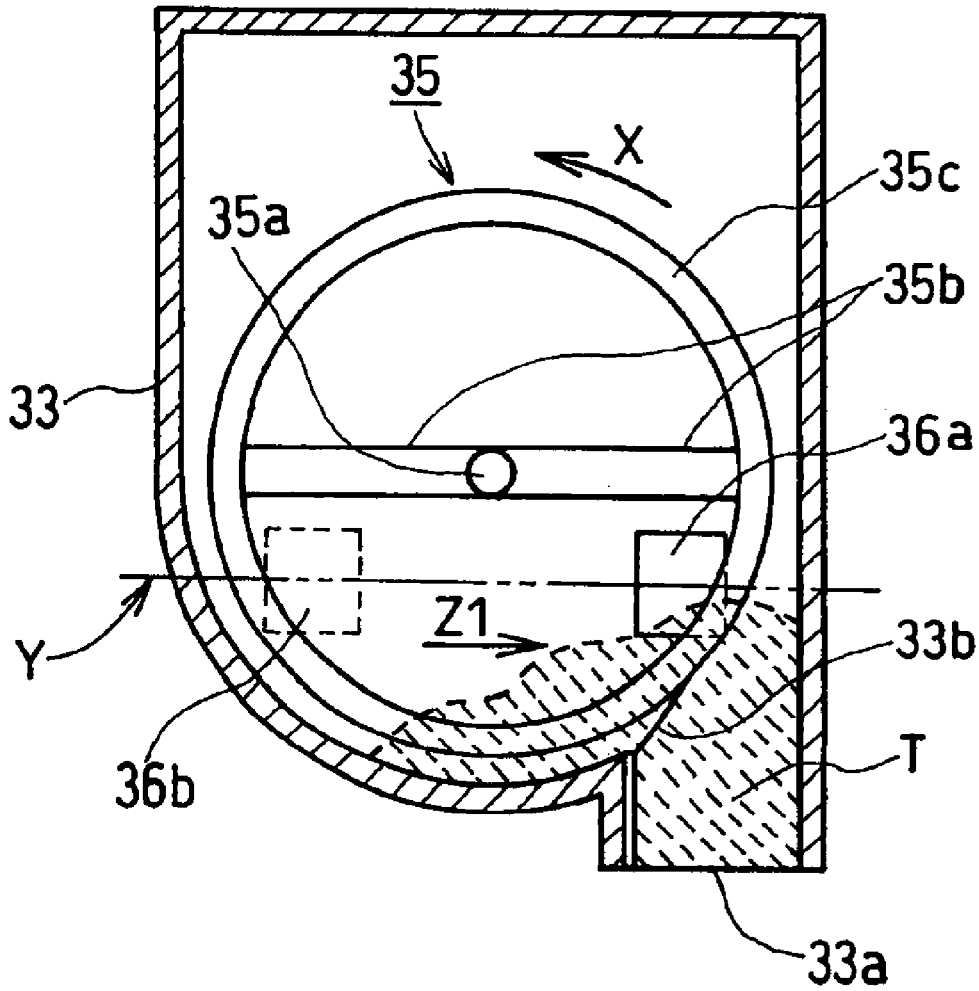
FIG. 2 is a sectional front view of a toner cartridge according to a first embodiment of the present invention.
Figure 3:
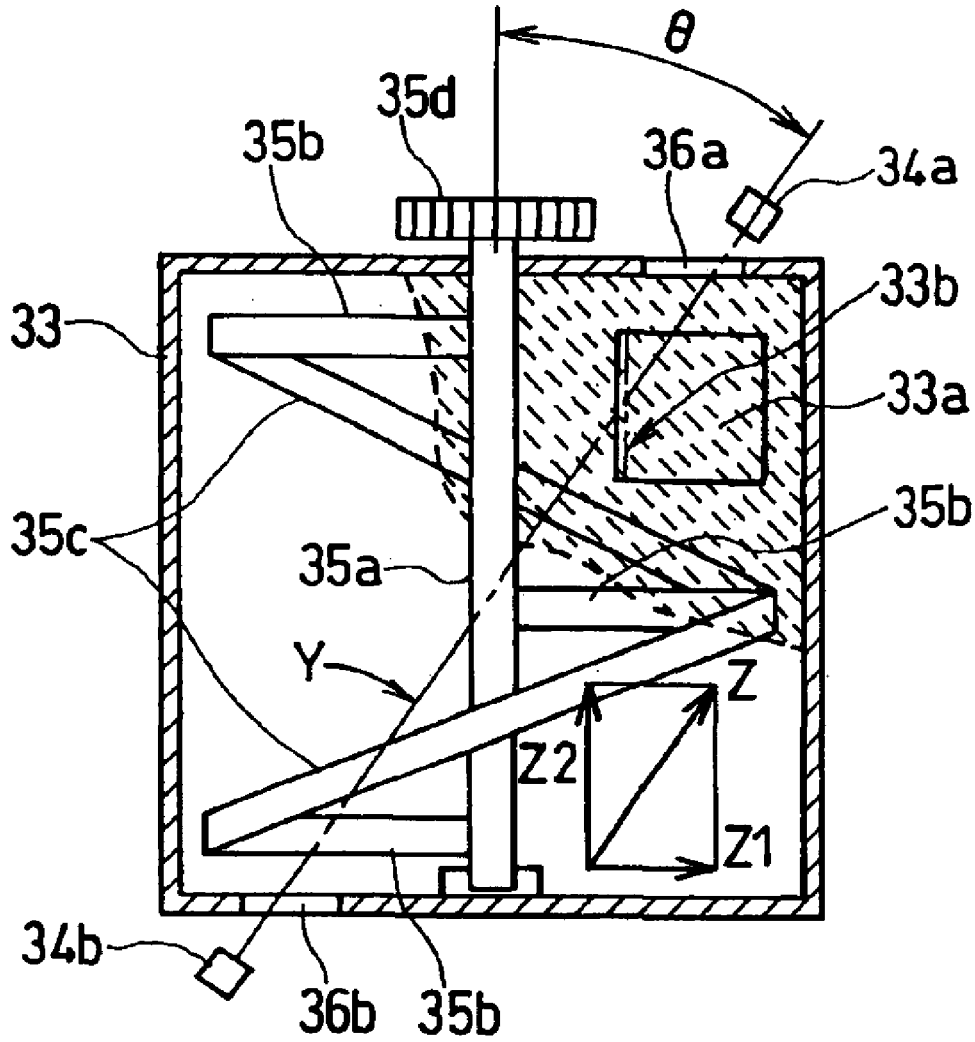
FIG. 3 is a sectional plan view of the toner cartridge shown in FIG. 2.

FIG. 2 is a sectional front view of a toner cartridge according to a first embodiment, and FIG. 3 is a sectional plan view of the toner cartridge. The toner cartridge 33 is a box-like container which has an exhaust port 33*a* for discharging toner T to the developing unit 30 and a rotary conveyance member 35 which is a rotary conveyance body supported therein rotatably.

The rotary conveyance member 35 has a stirring blade 35*c* twisted like a screw and connected to the ends of arms 35*b* mounted to a rotary shaft 35*a*, and a gear 35*d* fixed to one end of the rotary shaft 35*a* is connected to an unshown power source so that it turns in a direction shown by an arrow X.

A flexible member 33*b* composed of a synthetic resin piece is installed near the exhaust port 33*a* of the toner cartridge 33 in such a manner that it contacts the stirring blade 35*c* and is moved by the rotation of the stirring blade 35*c* to destroy the toner T residing near the exhaust port 33*a* in order to prevent the toner from crosslinking or residing. The flexible member 33*b* may be moved by contacting the arm 35*b* mounted to the rotary shaft 35*a*.

The toner cartridge 33 is provided with a detection window 36*a* and a detection window 36*b* through which a light beam passes at positions opposite to the light projection unit 34*a* and the light receiving unit 34*b* provided in the developing unit 30, respectively.

As described above, the toner detector 34 provided in the developing unit 30 comprises the light projection unit 34*a* and the light receiving unit 34*b*. In FIG. 2 and FIG. 3, letter Y denotes the optical axis of an optical path from the light projection unit 34*a* to the light receiving unit 34*b*. Since the optical axis Y shows the center of the optical path of the light beam projected from the light projection unit 34*a* to the light receiving unit 34*b*, it may be referred to as "optical path Y" in the following description.

In the developing unit 30, the light projection unit 34*a* and the light receiving unit 34*b* which constitute the toner detector 34 may be exchanged with each other. Further, in this embodiment, the toner detector 34 (the light projecting unit 34*a* and the light receiving unit 34*b*) is provided in the developing unit. It is needless to say that the toner detector may be provided in the image forming apparatus. This shall apply to other embodiments.

As shown in FIG. 3, the detection window 36*a* and the detection window 36*b* are located at positions where the optical axis Y passing through the above two detection windows intersects the rotation shaft 35*a* of the rotary conveyance member 35 at a slant angle θ on a projection plane when seen from the top of the toner cartridge 33.

In order to detect the existence of the toner T near the exhaust port 33*a* of the toner cartridge 33 stably, the optical path Y traverses above the exhaust port 33*a* in a horizontal direction, and the detection windows 36*a* and 36*b* and the light projection unit 34*a* and the light receiving unit 34*b* are arranged in the moving direction of the toner T.

A description is subsequently given of the operation of the above constitution. Since the toner T in the toner cartridge 33 receives force going toward a direction shown by an arrow Z1 and a direction shown by an arrow Z2 in FIG. 3 by the rotation of the stirring blade 35*c*, the toner T moves in a direction shown by an arrow Z from lower left to upper right in FIG. 3 (oblique direction with respect to the rotary shaft 35*a* of the stirring blade 35*c*) and is carried toward the exhaust port 33*a*.

The light beam projected from the light projection unit 34*a* and passing through the detection window 36*a* goes along the optical path Y. When the toner T resides near the exhaust port 33*a*, the optical path Y is cut off by the residing toner T and the light beam is not input into the light receiving unit 34*b*. That is, the existence of the toner T is detected. On the other hand, when the amount of the remaining toner T is small and the toner T does not reside near the exhaust port 33*a* or does not exist in the optical path Y, the optical path Y is not cut off and the light beam is input into the light receiving unit 34*b*, whereby it is detected that there is no toner T or the amount of the remaining toner T is a predetermined amount or less.

Since the optical path Y is substantially parallel to the direction shown by the arrow Z which is the moving direction of the toner T, if the amount of the remaining toner T is small, when a predetermined limit amount of the toner resides in the optical path Y, the light beam is cut off, whereby the existence of the toner T is detected.

As described above, the optical axis Y from the light projection unit 34*a* to the light receiving unit 34*b* is inclined at an angle θ from the rotary shaft 35*a* of the stirring blade 35*c*. The angle θ must be set to ensure that the outer diameter of the stirring blade 35*c* and the length of the rotary shaft 35*a* must maintain the relationship of the following expression (1).

$$\tan\theta = (\text{outer diameter of stirring blade } \mathbf{35}c)/(\text{length of rotary shaft } \mathbf{35}a) \quad (1)$$

When the angle θ formed by the optical axis Y and the rotary shaft 35*a* of the stirring blade 35*c* is set to ±30° from the angle calculated from the expression (1), variations in the detection value of the amount of the remaining toner T near the exhaust port 33*a* caused by the bias of the toner T can be made small.

Second Embodiment

Figure 4:
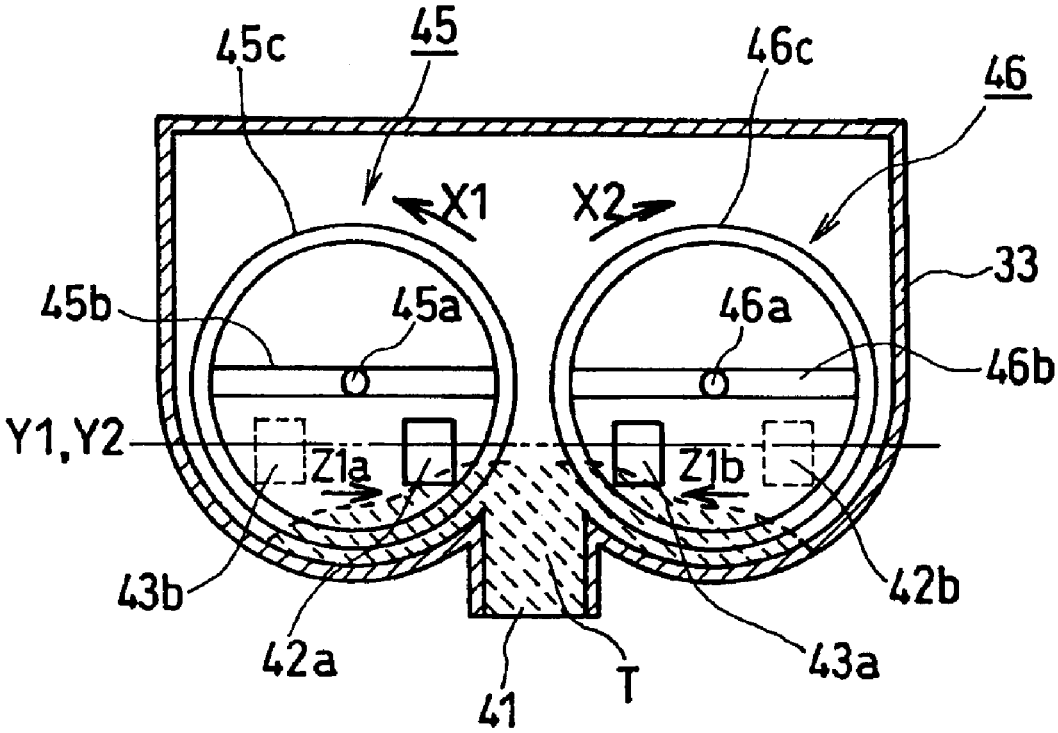
FIG. 4 is a sectional front view of a toner cartridge according to a second embodiment of the present invention.
Figure 5:
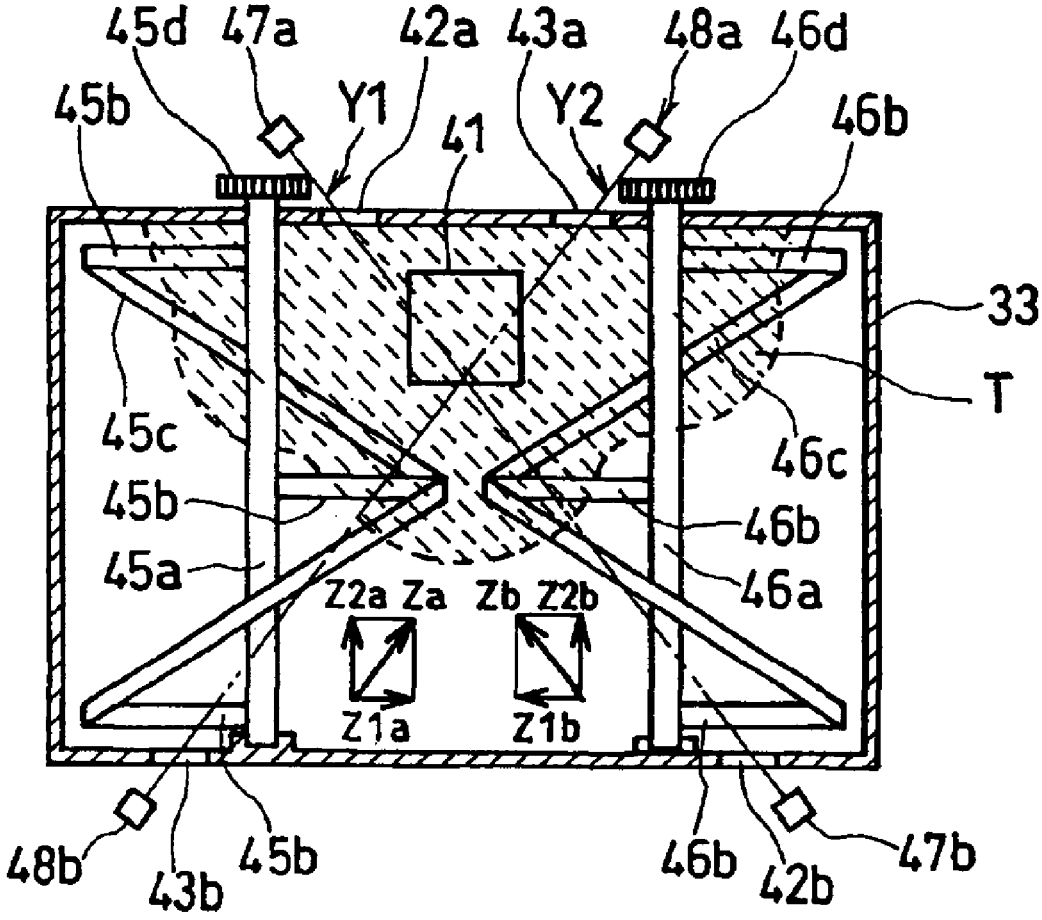
FIG. 5 is a sectional plan view of the toner cartridge shown in FIG. 4.

FIG. 4 is a sectional front view of a toner cartridge according to a second embodiment of the present invention, and FIG. 5 is a sectional plan view of the toner cartridge. The toner cartridge of the second embodiment corresponds to the toner cartridge 33 of the above image forming apparatus 10 (see FIG. 1).

In FIG. 4 and FIG. 5, the toner cartridge 33 is a box-like container and has an exhaust port 41 for discharging the toner T to the developing unit 30 and two rotary conveyance members 45 and 46 which are rotary conveyance bodies supported therein rotatably.

The rotary conveyance member 45 has a stirring blade 45*c* twisted like a screw and connected to the ends of arms 45*b* mounted to a rotary shaft 45*a*, and a gear 45*d* fixed to one end of the rotary shaft 45*a* is connected to an unshown power source so that it turns in a direction shown by an arrow X1.

The rotary conveyance member 46 has a stirring blade 46*c* twisted like a screw and connected to the ends of arms 46*b* mounted to a rotary shaft 46*a*, and a gear 46*d* fixed to one end of the rotary shaft 46*a* is connected to an unshown power source so that it turns in a direction shown by an arrow X2 opposite to the direction shown by the arrow X2.

In the second embodiment, the toner detector 34 as developer detection means mounted to the developing unit 30 comprises a light projection unit 47*a* having light emitting elements, a light receiving unit 47*b* having light receiving elements, a light projection unit 48*a* having light emitting elements and a light receiving unit 48*b* having light receiving elements.

In accordance with this, the toner cartridge 33 is provided with a detection window 42*a* and a detection window 42*b* through which a light beam passes at positions opposite to the above light projection unit 47*a* and light receiving unit 47*b* and a detection window 43*a* and a detection window 43*b* through which a light beam passes at positions opposite to the above light projection unit 48*a* and light receiving unit 48*b*, respectively.

Symbol Y1 denotes the optical axis of an optical path from the light projection unit 47*a* to the light receiving unit 47*b* and symbol Y2 denotes the optical axis of an optical path from the light projection unit 48*a* to the light receiving unit 48*b*. The optical axes Y1 and Y2 are inclined obliquely from the rotary shafts 45*a* and 46*a*, respectively. Since the optical axes Y1 and Y2 show the centers of the optical paths of a light beam projected from the light projection unit 47*a* toward the light receiving unit 47*b* and a light beam projected from the light projecting unit 48*a* toward the light receiving unit 48*b*, the optical axes Y1 and Y2 may be referred to as "optical paths Y1 and Y2" in the following description, respectively.

As shown in FIG. 5, the detection windows 42*a* and 42*b*, and the detection windows 43*a* and 43*b* are arranged at positions where the optical axes Y1 and Y2 passing through the above detection windows intersect the rotary shaft 46*a* of the rotary conveyance member 46 and the rotary shaft 45*a* of the rotary conveyance member 45 at a fixed slant angle on a projection plane, respectively, when seen from the top of the toner cartridge 33.

In order to detect the existence of the toner T near the exhaust port 41 of the toner cartridge 33 stably, the optical paths Y1 and Y2 traverse above the exhaust port 41 in a horizontal direction, and the detection windows 42*a* and 42*b*, the detection windows 43*a* and 43*b*, the light projecting unit 47*a* and the light receiving unit 47*b*, and the light projecting unit 48*a* and the light receiving unit 48*b* are arranged in the moving direction of the toner T. The optical path Y1 is parallel to a direction shown by an arrow Zb which is the moving direction of the toner T to be described hereinafter, and the optical path Y2 is parallel to a direction shown by an arrow Za which is the moving direction of the toner T to be described hereinafter.

A description is subsequently given of the operation of the above constitution. Out of the toner T in the toner cartridge 33, toner T influenced by the rotation of the stirring blade 45*c* receives force going toward a direction shown by an arrow Z1*a* and a direction shown by an arrow Z2*a* in FIG. 5 to move in a direction shown by an arrow Za from lower left to upper right and toner T influenced by the rotation of the stirring blade 46*c* receives force going toward a direction shown by an arrow Z1*b* and a direction shown by an arrow Z2*b* in FIG. 5 to move in a direction shown by an arrow Zb from lower right to upper left. Thereby, the toner T in the toner cartridge 33 is carried toward the exhaust port 41.

A light beam projected from the light projecting unit 47*a* and passing through the detection window 42*a* goes along the optical path Y1. When the toner T resides near the exhaust port 41, the optical path Y1 is cut off by the residing toner T and the light beam is not input into the light receiving unit 47*b*, whereby the existence of the toner T is detected. On the other hand, when the amount of the remaining toner T is small and the toner T does not reside near the exhaust port 41 or does not exist in the optical path Y1, the optical path Y1 is not cut off and the light beam is input into the light receiving unit 47*b*, whereby it is detected that there is no toner T or the amount of the remaining toner T is a predetermined amount or less.

Similarly, a light beam projected from the light projecting unit 48*a* and passing through the detection window 43*a* goes along the optical path Y2. When the toner T resides near the exhaust port 41, the optical path Y2 is cut off by the residing toner T and the light beam is not input into the light receiving unit 48*b*, whereby the existence of the toner T is detected. On the other hand, when the amount of the remaining toner T is small and the toner T does not reside near the exhaust port 41 or does not exist in the optical path Y2, the optical path Y2 is not cut off and the light beam is input into the light receiving unit 48*b*, whereby it is detected that there is no toner T or the amount of the remaining toner T is a predetermined amount or less.

Since the above optical path Y1 and optical path Y2 cross each other near the exhaust port 41, even if the amount of the remaining toner T becomes small but a predetermined limit value or more, the optical path Y1 or Y2 is cut off by the residing toner T, whereby the existence of the toner is detected.

In the above constitution, two rotary conveyance members 45 and 46 are provided. Three or more rotary conveyance members may be provided optionally. As for the constitution of the developing unit 30, the light projecting unit 47*a* and the light receiving unit 47*b* and the light projecting unit 48*a* and the light receiving unit 48*b* which constitute the toner detector 34 may be exchanged with each other.

Third Embodiment

Figure 6:
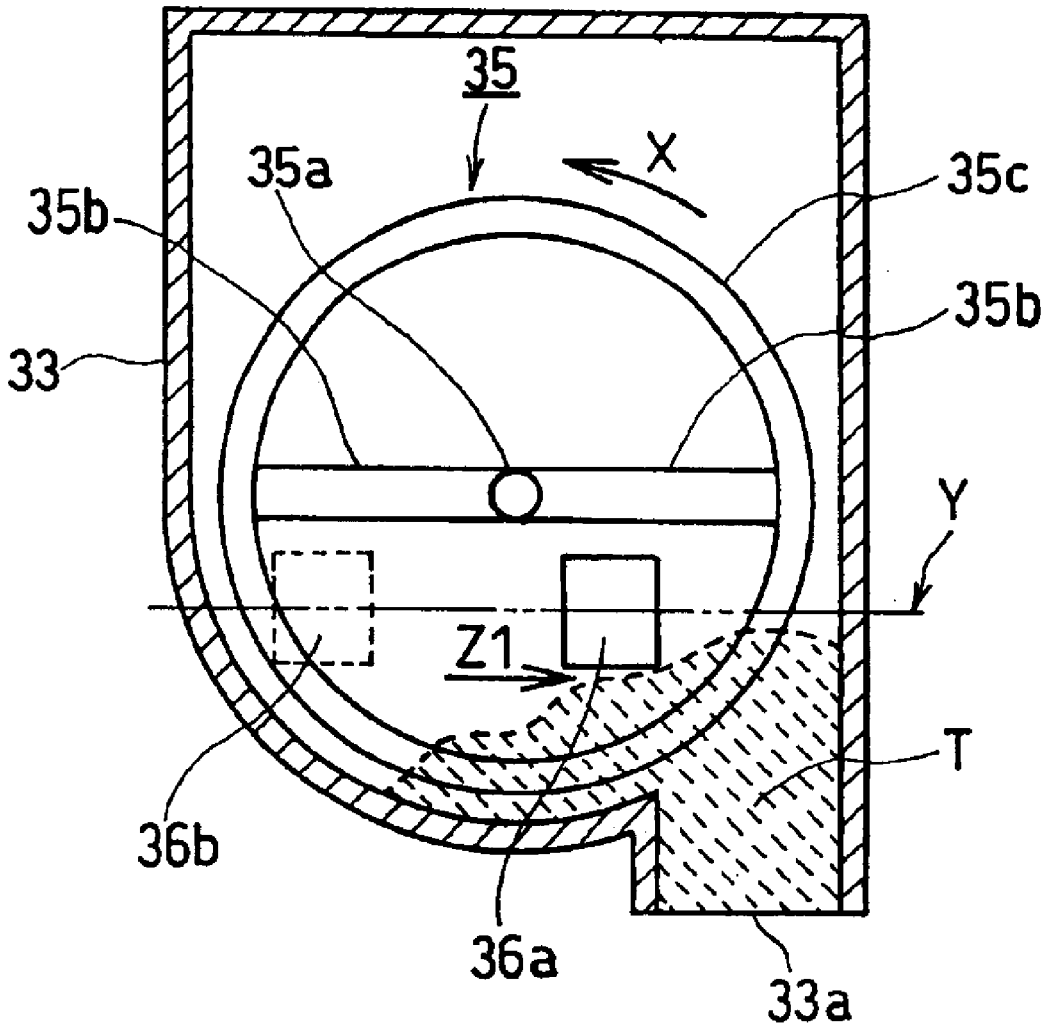
FIG. 6 is a sectional front view of a toner cartridge according to a third embodiment of the present invention.
Figure 7:
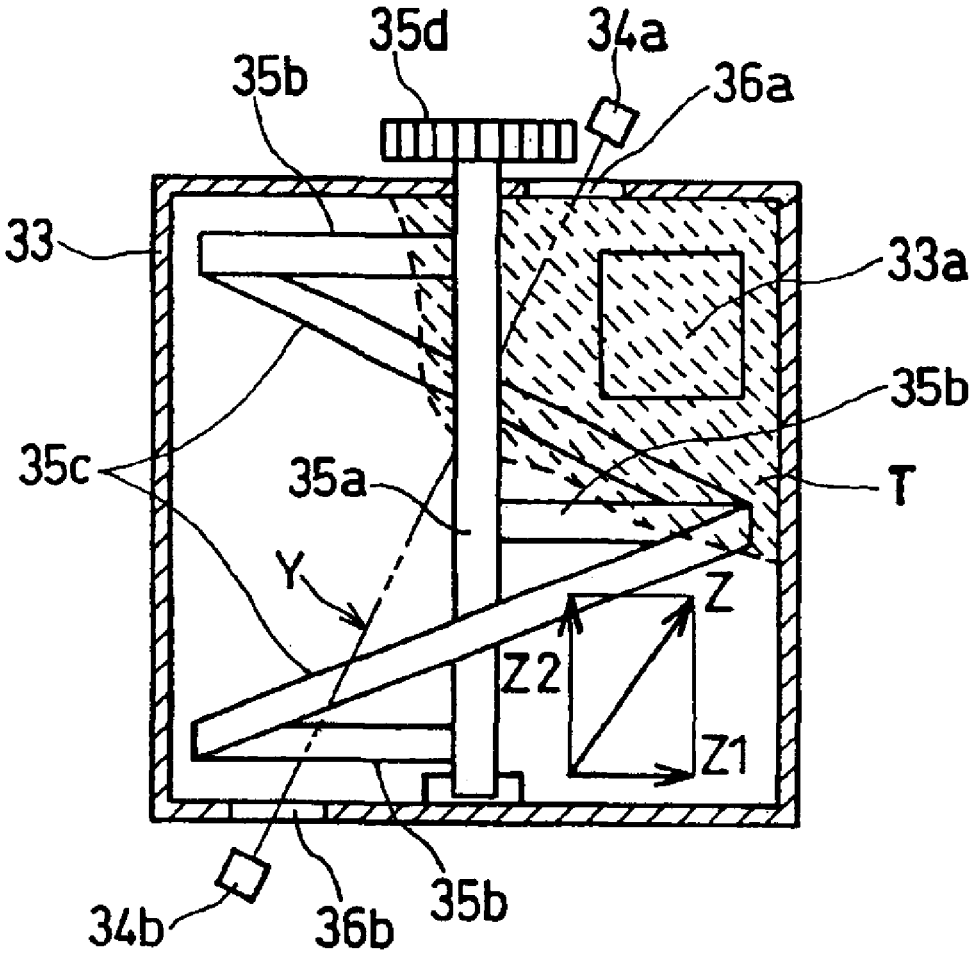
FIG. 7 is a sectional plan view of the toner cartridge shown in FIG. 6.

FIG. 6 is a sectional front view of a toner cartridge according to a third embodiment, and FIG. 7 is a sectional plan view of the toner cartridge. The toner cartridge of the third embodiment corresponds to the toner cartridge 33 of the above image forming apparatus 10 (see FIG. 1).

In the above first embodiment, the light projecting unit 34*a* and the light receiving unit 34*b* are arranged such that the optical path Y becomes parallel to the moving direction (shown by the arrow Z) of the toner T and passes over the exhaust port 33*a*. In the second embodiment, the light projecting unit 47*a* and the light receiving unit 47*b* and the light projecting unit 48*a* and the light receiving unit 48*b* are arranged such that the optical paths Y1 and Y2 become parallel to the directions shown by the arrow Zb and the arrow Za which are the moving directions of the toner T, respectively and pass over the exhaust port 41.

In contrast to this, in the third embodiment, the optical path Y is parallel to the moving direction of the toner T (direction shown by the arrow Z) but the light projecting unit and the light receiving unit are arranged at positions where the optical path Y does not pass over the vertical direction of the exhaust port.

The toner cartridge of the third embodiment differs from the toner cartridge of the first embodiment in that the positions of the light projecting unit and the light receiving unit but the same as the toner cartridge of the first embodiment in other constitution. The same members have the same symbols and their detailed descriptions are omitted. Only the difference will be described hereinunder.

In FIG. 6 and FIG. 7, the toner cartridge 33 has a detection window 36*a* and a detection window 36*b* through which a light beam passes at positions opposite to the light projecting unit 34*a* and the light receiving unit 34*b* provided in the developing unit 30, respectively.

As described above, the toner detector 34 provided in the developing unit 30 comprises the light projecting unit 34*a* and the light receiving unit 34*b*. The light projecting unit 34*a* and the light receiving unit 34*b* may be exchanged with each other.

The optical path Y from the light projecting unit 34*a* to the light receiving unit 34*b* is inclined at a fixed angle from the rotary shaft 35*a* of the stirring blade 35*c* in a direction parallel to the direction shown by the arrow Z which is the moving direction of the toner T and extends over the exhaust port 33*a* in a horizontal direction but is located at a position where it does not pass over the vertical direction of the exhaust port 33*a*.

Since the light projecting unit 34*a* and the light receiving unit 34*b* which constitute the toner detector 34 detect the existence of the toner T near the exhaust port 33*a* of the toner cartridge 33 stably, the optical path Y from the light projecting unit 34*a* to the light receiving unit 34*b* traverses above the exhaust port 33*a* in a horizontal direction and the detection window 36*a* and the detection window 36*b* and the light projecting unit 34*a* and the light receiving unit 34*b* are arranged in a direction parallel to the moving direction of the toner T.

The rotary conveyance member 35 has a stirring blade 35*c* connected to arms 35*b* mounted to a rotary shaft 35*a*, and a gear 35*d* is connected to an unshown power source to be turned in a direction shown by the arrow X.

A description is subsequently given of the operation of the above constitution. Since the toner T in the toner cartridge 33 receives force going toward the direction shown by the arrow Z1 and the direction shown by the arrow Z2 in FIG. 7 by the rotation of the stirring blade 35*c*, the toner T moves in the direction shown by the arrow Z from lower left to upper right in FIG. 7 (direction intersecting the rotary shaft 35*a* of the stirring blade 35*c* obliquely) and is carried toward the exhaust port 33*a*.

A light beam projected from the light projecting unit 34*a* and passing through the detection window 36*a* goes along the optical path Y. When the toner T resides near the exhaust port 33*a*, the optical path Y is cut off by the residing toner T and the light beam is not input into the light receiving unit 34*b*, whereby the existence of the toner T is detected. On the other hand, when the amount of the remaining toner T is small and the toner T does not reside near the exhaust port 33*a* or does not exist in the optical path Y, the optical path Y is not cut off and the light beam is input into the light receiving unit 34*b*, whereby it is detected that there is no toner T or the amount of the remaining toner T is a predetermined amount or less.

Fourth Embodiment

Figure 8:
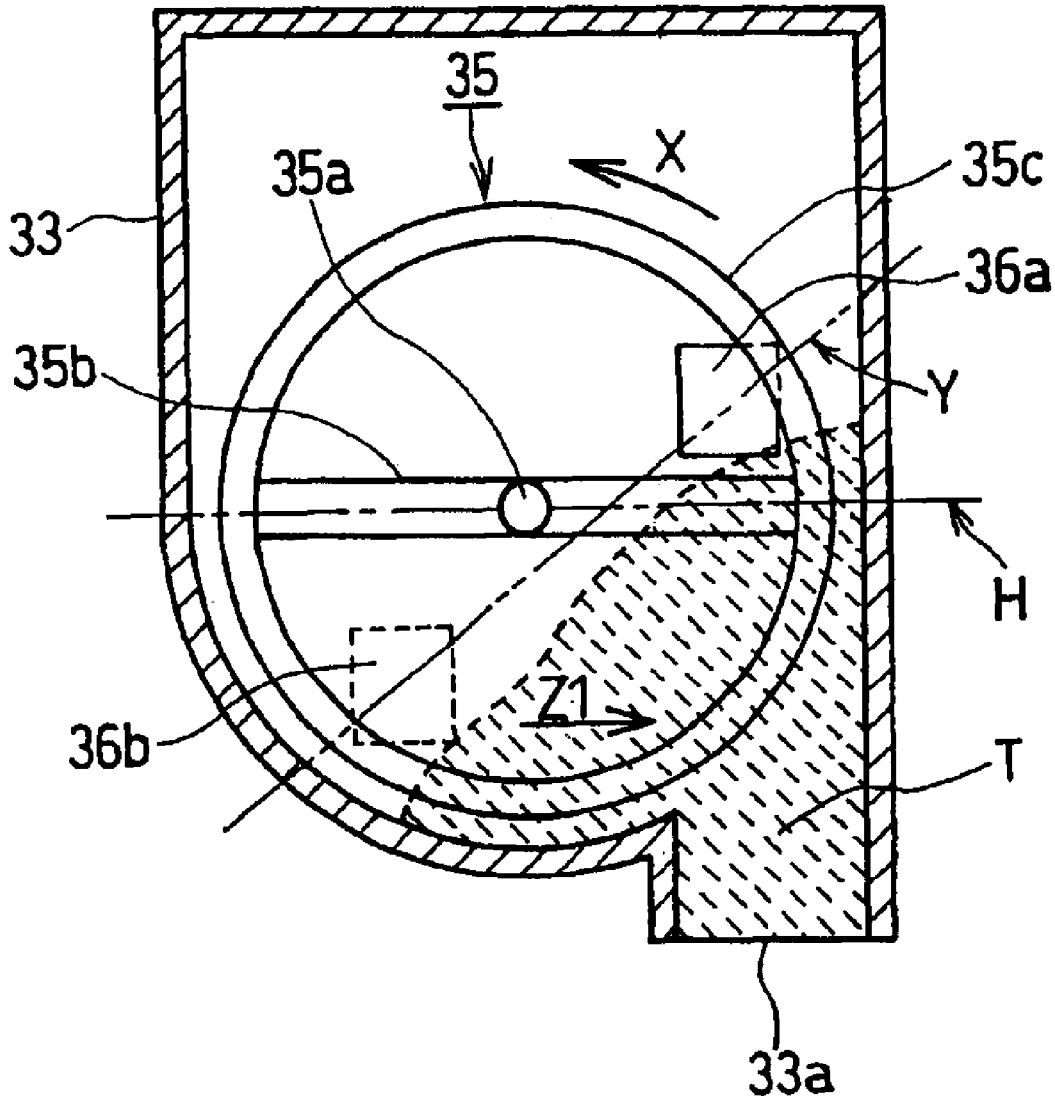
FIG. 8 is a sectional front view of a toner cartridge according to a fourth embodiment of the present invention.
Figure 9:
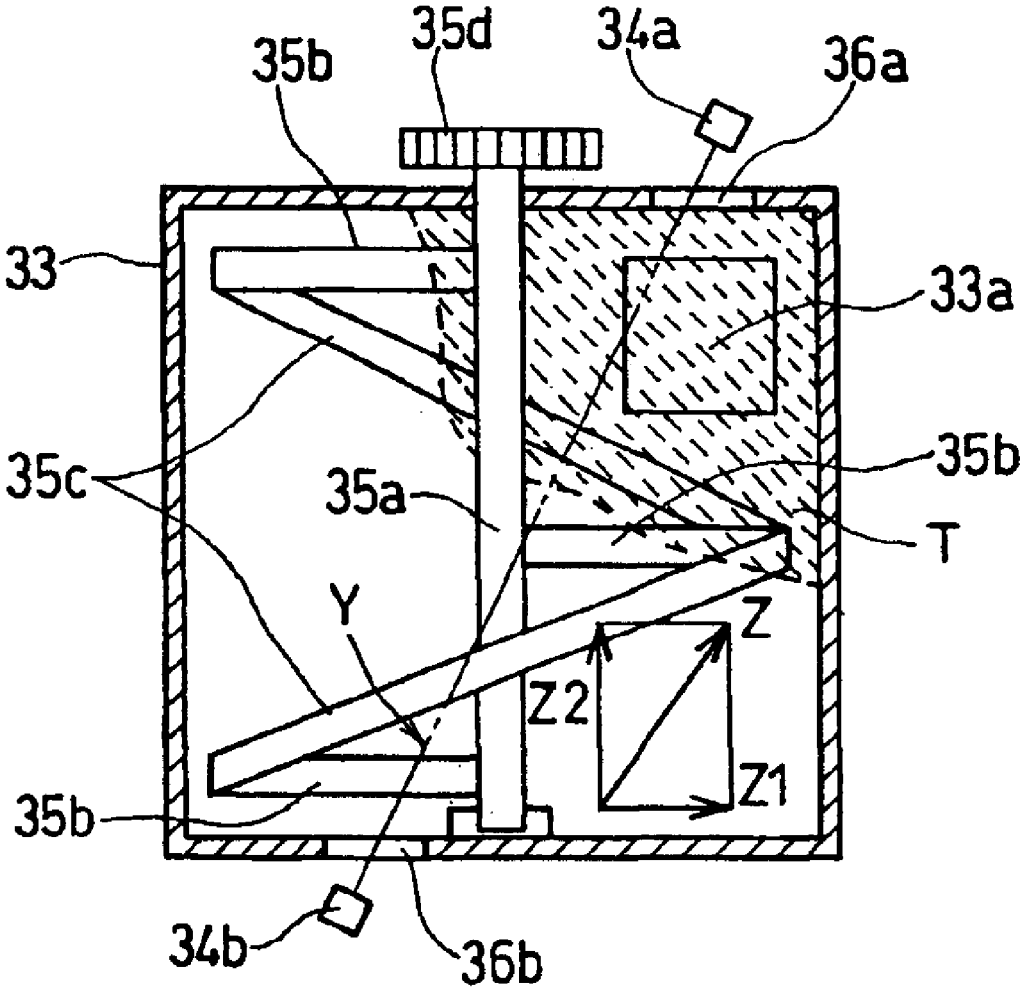
FIG. 9 is a sectional plan view of the toner cartridge shown in FIG. 8.

FIG. 8 is a sectional front view of a toner cartridge according to a fourth embodiment, and FIG. 9 is a sectional plan view of the toner cartridge. The toner cartridge of the fourth embodiment corresponds to the toner cartridge 33 of the above image forming apparatus 10 (see FIG. 1).

The toner cartridge of the fourth embodiment differs from the toner cartridge of the first embodiment in the arrangement positions of the detection window 36*a* and the detection window 36*b* for detecting the existence of the toner but the same as the toner cartridge of the first embodiment in other constitution. The same members have the same reference symbols and their detailed descriptions are omitted. Only the difference will be described hereinbelow.

In FIG. 8 and FIG. 9, the toner cartridge 33 is a box-like container and has an exhaust port 33*a* for discharging the toner T to the developing unit 30 and a rotary conveyance member 35 which is a rotary conveyance body supported therein rotatably.

The rotary conveyance member 35 has a stirring blade 35*c* connected to arms 35*b* mounted to a rotary shaft 35*a*, and a gear 35*d* is connected to an unshown power source to be turned in the direction shown by the arrow X. The toner cartridge 33 is provided with a detection window 36*a* and a detection window 36*b*.

A description is subsequently given of the arrangement of the light projecting unit 34*a* and the light receiving unit 34*b* of the toner detector 34 of the developing unit 30. In order to detect the existence of the toner T near the exhaust port 33*a* of the toner cartridge 33 stably, the light projecting unit 34*a* and the light receiving unit 34*b* are arranged such that the optical path Y from the light projecting unit 34*a* to the light receiving unit 34*b* goes from above to below the horizontal plane H including the axis of the above rotary shaft 35*a*.

Meanwhile, the detection window 36*a* and the detection window 36*b* of the toner cartridge 33 are arranged at positions opposite to the above light projecting unit 34*a* and light receiving unit 34*b*, respectively. The optical path Y is parallel to the direction shown by the arrow Z which is the moving direction of the toner T and intersects the rotary shaft 35*a* of the stirring blade 35*c* at a predetermined angle and passes over the exhaust port 33*a*.

A description is given of the operation of the above constitution. Since the toner T in the toner cartridge 33 receives force going toward the direction shown by the arrow Z1 and the direction shown by the arrow Z2 in FIG. 8 by the rotation of the stirring blade 35*c*, the toner T moves in the direction shown by the arrow Z (direction intersecting the rotary shaft 35*a* of the stirring blade 35*c* obliquely) from lower left to upper right in FIG. 8 and is carried toward the exhaust port 33*a*.

A light beam projected from the light projecting unit 34*a* and passing through the detection window 36*a* goes along the optical path Y. When the toner T resides near the exhaust port 33*a*, the optical path Y is cut off by the residing toner T and the light beam is not input into the light receiving unit 34*b*, whereby the existence of the toner T is detected. On the other hand, when the amount of the remaining toner T is small and the toner T does not reside near the exhaust port 33*a* or does not exist in the optical path Y, the optical path Y is not cut off and the light beam is input into the light receiving unit 34*b*, whereby it is detected that there is no toner T or the amount of the remaining toner T is a predetermined amount or less.

In the above embodiment, the light projecting unit 34*a* and the light receiving unit 34*b* are arranged such that the optical path Y goes from above to below the horizontal plane H including the axis of the above rotary shaft 35*a*. That is, the light projecting unit 34*a* is located above the horizontal plane H and the light receiving unit 34*b* is located below the horizontal plane H. On the contrary, the light receiving unit 34*b* may be located above the horizontal plane H and the light projecting unit 34*a* may be located below the horizontal plane H.

Fifth Embodiment

Figure 10:
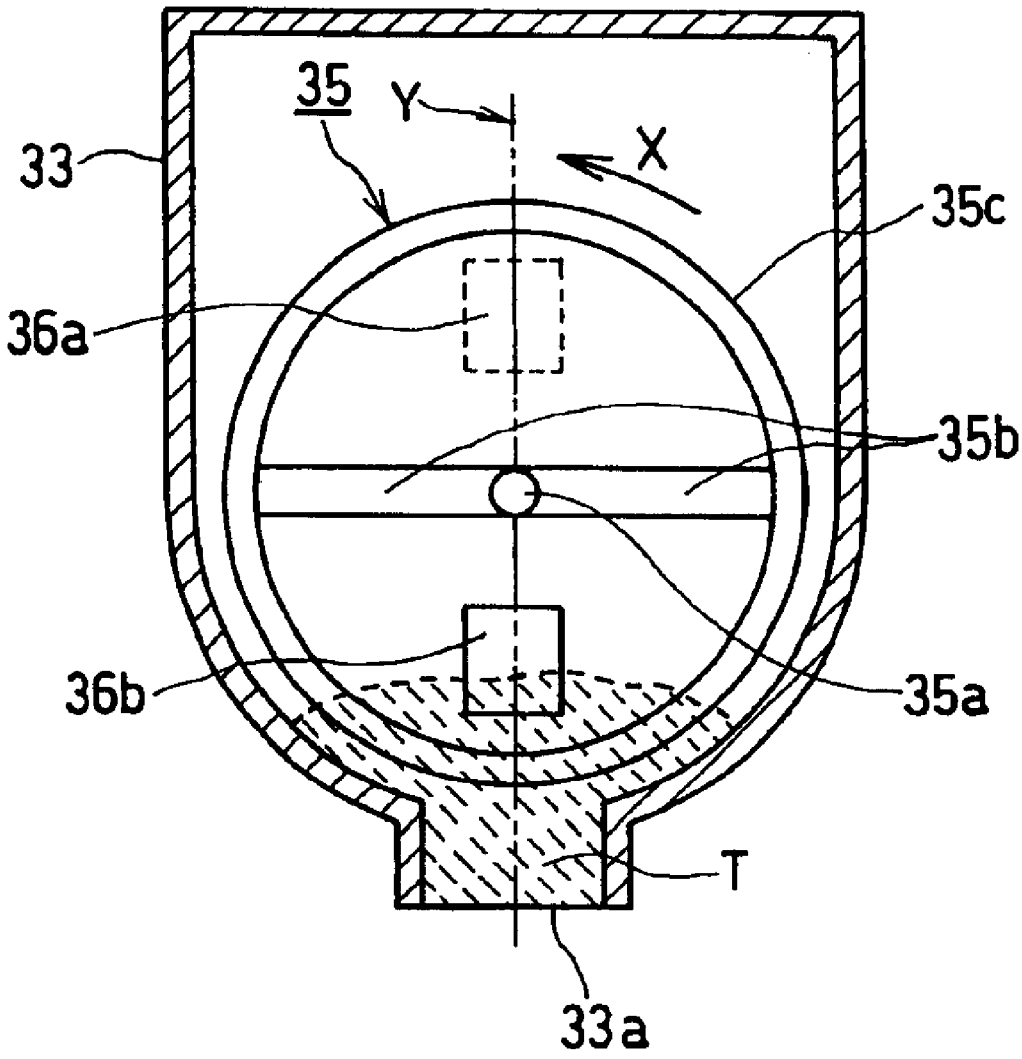
FIG. 10 is a sectional front view of a toner cartridge according to a fifth embodiment of the present invention.
Figure 11:
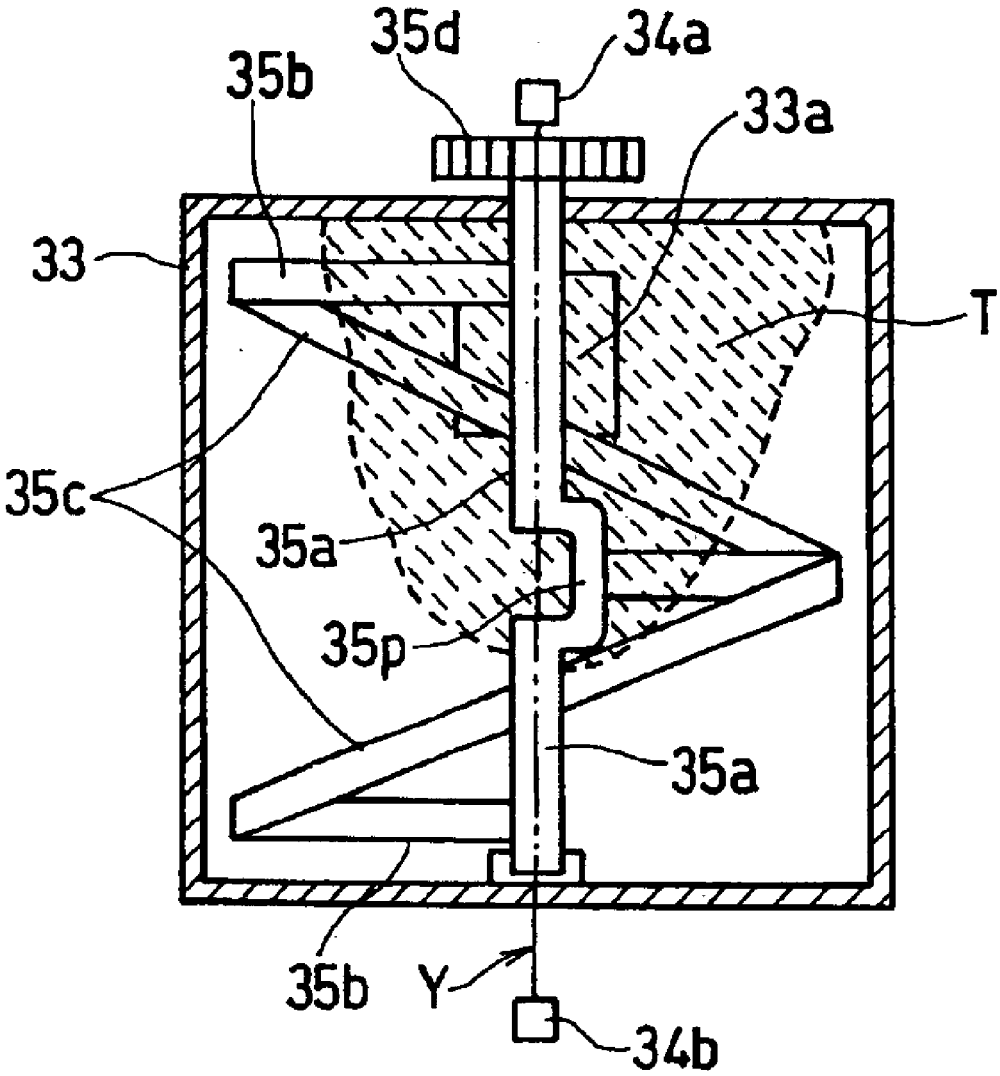
FIG. 11 is a sectional plan view of the toner cartridge shown in FIG. 10.
Figure 12:
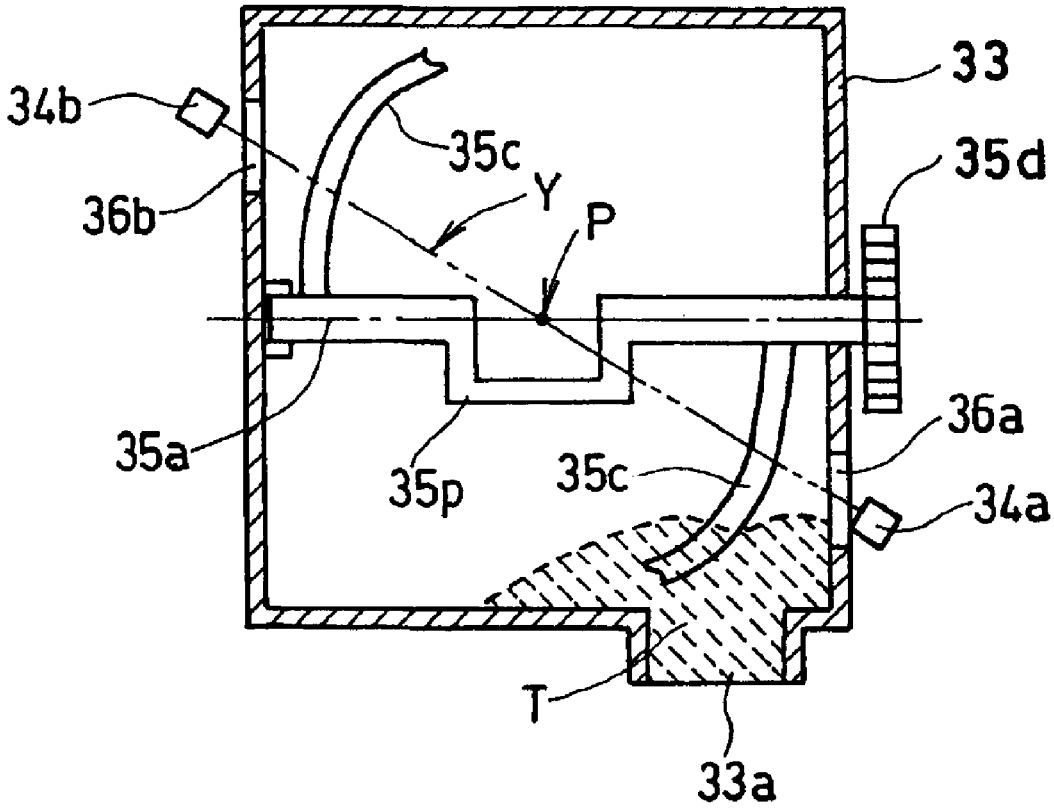
FIG. 12 is a sectional side view of the toner cartridge shown in FIG. 10.

FIG. 10 is a sectional front view of a toner cartridge according to a fifth embodiment, FIG. 11 is a sectional plan view of the toner cartridge, and FIG. 12 is a sectional longitudinal view of the toner cartridge. The toner cartridge of the fifth embodiment corresponds to the toner cartridge 33 of the above image forming apparatus 10 (see FIG. 1).

The toner cartridge of the fifth embodiment differs from the toner cartridge of the first embodiment in the arrangement of the light projecting unit and the light receiving unit and the constitution of the rotary shaft of the rotary conveyance member but the same as the toner cartridge of the first embodiment in other constitution. Therefore, the same members have the same reference symbols and their detailed descriptions are omitted. The differences between them will be described hereinunder.

In FIG. 10 to FIG. 12, the toner cartridge 33 is a box-like container and has an exhaust port 33*a* for discharging toner T to the developing unit 30 and a rotary conveyance member 35 which is a rotary conveyance body supported therein rotatably.

The rotary conveyance member 35 has a stirring blade 35*c* twisted like a screw and connected to the ends of arms 35*b* mounted to a rotary shaft 35*a*, and a substantially U-shaped curved portion 35*p* is formed in substantially the center portion of the rotary shaft 35*a*. The toner cartridge 33 is provided with a detection window 36*a* and a detection window 36*b* (see FIG. 12).

The arrangement of the light projecting unit 34*a* and the light receiving unit 34*b* of the toner detector 34 of the developing unit 30 will be described hereinunder. The light projecting unit 34*a* and the light receiving unit 34*b* are arranged such that the optical path Y from the light projecting unit 34*a* to the light receiving unit 34*b* traverses above the exhaust port 33*a* aslant in a horizontal direction in order to detect the existence of the toner T near the exhaust port 33*a* of the toner cartridge 33 stably. In the above constitution, the light projecting unit 34*a* and the light receiving unit 34*b* may be exchanged with each other.

The toner cartridge 33 is arranged such that the axis of the rotary shaft 35*a* of the rotary conveyance member 35 incorporated therein intersects the optical path Y from the light projecting unit 34*a* to the light receiving unit 34*b* at substantially the center point P of the rotary shaft 35*a*. Since the substantially U-shaped curved portion 35*p* is formed at substantially the center portion of the rotary shaft 35*a*, a light beam projected from the light projecting unit 34*a* to the light receiving unit 34*b* is cut off just once for a short period of time during one revolution of the rotary shaft 35*a* but the light beam passes near the curved portion 35*p* and is not cut off during other time.

As shown in FIG. 12, the detection window 36*a* and the detection window 36*b* of the toner cartridge 33 are located at positions where the optical axis Y passing through the above two detection windows intersects the rotary shaft 35*a* of the rotary conveyance member 35 at a fixed slant angle on a projection plane when seen from the side of the toner cartridge 33.

The operation of the above constitution will be described hereinunder. The toner T in the toner cartridge 33 is carried toward the exhaust port 33*a* by the rotation of the stirring blade 35*c*. A light beam projected from the light projecting unit 34*a* of the toner detector 34 and passing through the detection window 36*a* goes along the optical path Y. When the toner T resides near the exhaust port 33*a*, the optical path Y is cut off by the residing toner T and the light beam is not input into the light receiving unit 34*b*, whereby the existence of the toner T is detected. On the other hand, when the amount of the remaining toner T is small and the toner T does not reside near the exhaust port 33*a* or does not exist in the optical path Y, the optical path Y is not cut off and the light beam is input into the light receiving unit 34*b*, whereby it is detected that there is no toner T or the amount of the remaining toner T is a predetermined amount or less.

In this embodiment, the curved portion 35*p* of substantially the center portion of the rotary shaft 35*a* is substantially U-shaped. The curved portion may have any shape if it does not cut off the optical path Y.

Sixth Embodiment

The toner cartridges of the first to fifth embodiments which have been described above are a toner cartridge suitable for a light transmission type toner detector whose light projecting unit and light receiving unit are separated from an end portion such as a side wall of the toner cartridge so that a light beam projected from the light projecting unit is detected by the light receiving unit.

In contrast to this, the toner cartridge of the sixth embodiment is a toner cartridge suitable for a reflection type toner detector whose light projecting unit and light receiving unit are arranged in proximity to an end portion such as a side wall of the toner cartridge so that a light beam projected from the light projecting unit is reflected by a reflection mirror and reflected light is detected by the light receiving unit.

Figure 13:
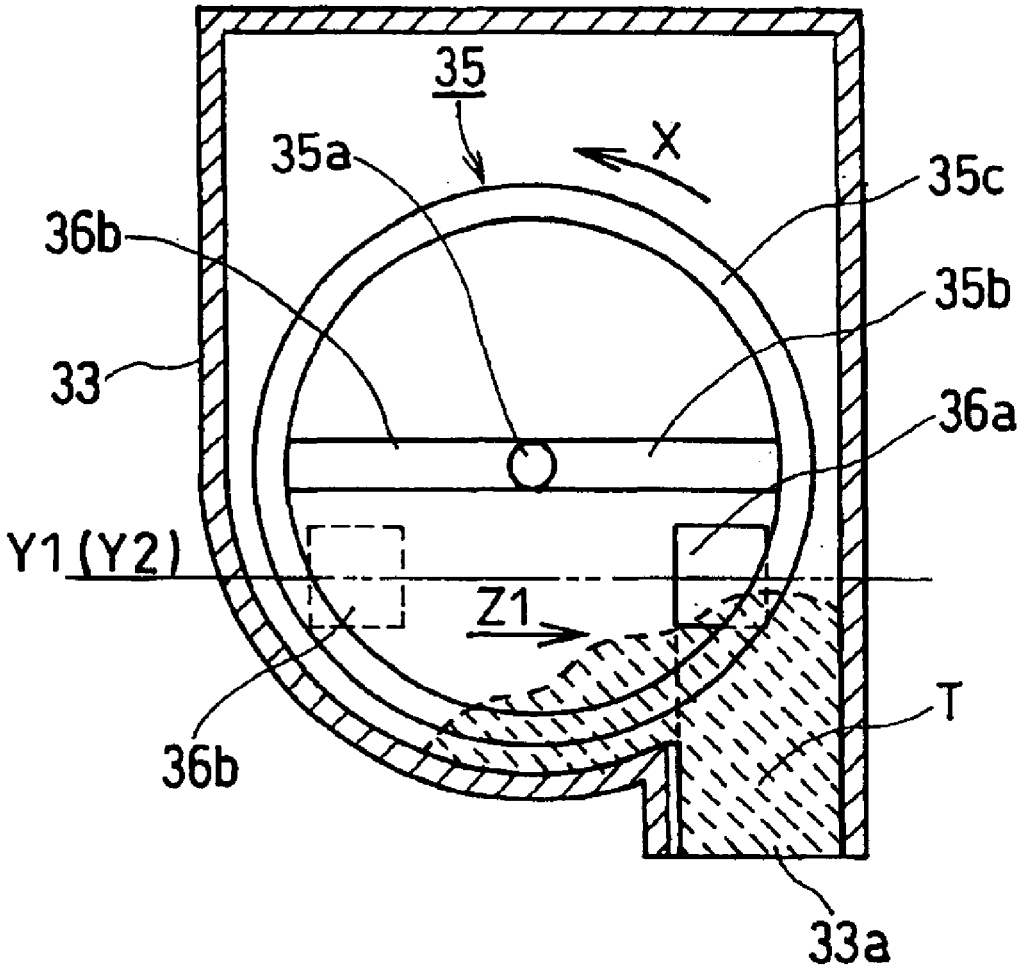
FIG. 13 is a sectional front view of a toner cartridge according to a sixth embodiment of the present invention.
Figure 14:
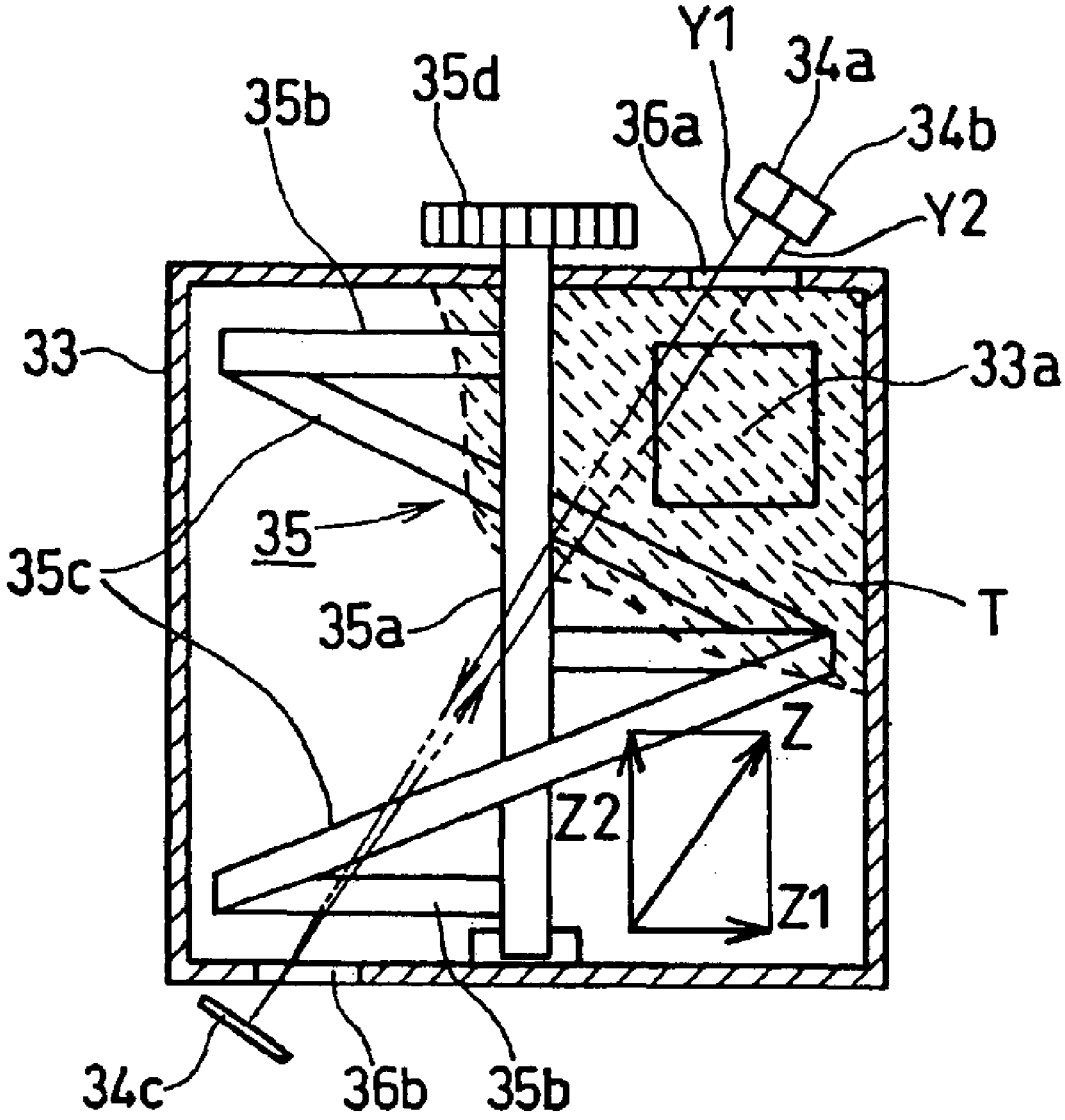
FIG. 14 is a sectional plan view of the toner cartridge shown in FIG. 13.

FIG. 13 is a sectional front view of a toner cartridge according to a sixth embodiment, and FIG. 14 is a sectional plan view of the toner cartridge. The toner cartridge of the sixth embodiment corresponds to the toner cartridge 33 of the above image forming apparatus 10 (see FIG. 1).

The toner cartridge of the sixth embodiment is the same as the toner cartridge of the first embodiment. The toner detector 34 of the developing unit 30 differs from the toner detector of the first embodiment in the constitution of the light projecting unit 34*a* and the light receiving unit 34*b* but the same as the toner detector of the first embodiment in other constitution. The same members have the same reference symbols and their detailed descriptions are omitted. The constitution of the light projecting unit and the light receiving unit of the toner detector will be described in relation to the toner cartridge.

In FIG. 13 and FIG. 14, the toner cartridge 33 is a box-like container and has an exhaust port 33*a* for discharging the toner T to the developing unit 30 and a rotary conveyance member 35 which is a rotary conveyance body supported therein rotatably. The toner cartridge 33 has a detection window 36*a* and a detection window 36*b* (see FIG. 13).

The toner detector 34 of the developing unit 30 comprises a light projecting unit 34*a* having light emitting elements, a light receiving unit 34*b* having light receiving elements, and a reflection mirror 34*c*.

That is, the light projecting unit 34*a* having light emitting elements and the light receiving unit 34*b* having light receiving elements are arranged close to each other at a position opposite to the detection window 36*a* of the toner cartridge 33, the reflection mirror 34*c* is placed at a position opposite to the detection window 36*b* on the opposite side to the detection window 36*a* of the toner cartridge 33, and a light beam projected from the light projecting unit 34*a* passes through the detection window 36*a* and the detection window 36*b* and is reflected by the reflection mirror 34*c*, passes through the detection window 36*b* and the detection window 36*a* and is input into the light receiving unit 34*b*.

In order to detect the existence of the toner T near the exhaust port 33*a* of the toner cartridge 33 stably, the light projecting unit 34*a* and the light receiving unit 34*b* of the toner detector 34 are arranged such that a projection optical path Y1 and a reflection optical path Y2 from the light projecting unit 34*a* to the light receiving unit 34*b* through the reflection mirror 34*c* traverse above the exhaust port 33*a* in a horizontal direction.

The operation of the above constitution will be described hereinunder. Since the toner T in the toner cartridge 33 receives force going toward the direction shown by the arrow Z1 and the direction shown by the arrow Z2 in FIG. 14 by the rotation of the stirring blade 35*c*, the toner T moves in the direction shown by the arrow Z from lower left to upper right in FIG. 14 (direction intersecting the rotary shaft 35*a* of the stirring blade 35*c* obliquely) and is carried toward the exhaust port 33*a*.

The light beam projected from the light projecting unit 34*a* and passing through the detection window 36*a* goes along the projection optical path Y1, passes through the detection window 36*b* and is reflected by the reflection mirror 34*c*. The reflected light beam goes along the reflection optical path Y2, passes through the detection window 36*b* and the detection window 36*a* and is input into the light receiving unit 34*b*.

When the toner T resides near the exhaust port 33*a*, either one of the projection optical path Y1 and the reflection optical path Y2 is cut off by the residing toner T and the light beam is not input into the light receiving unit 34*b*, whereby the existence of the toner T is detected. On the other hand, when the amount of the remaining toner T is small and the toner T does not reside near the exhaust port 33*a* or does not exist in both of the projection optical path Y1 and the reflection optical path Y2, the optical path Y (projection optical path Y1 and reflection optical path Y2) is not cut off and the light beam is input into the light receiving unit 34*b*, whereby it is detected that there is no toner T or the amount of the remaining toner T is a predetermined amount or less.

Since the projection optical path Y1 and the reflection optical path Y2 are substantially parallel to the direction shown by the arrow Z which is the moving direction of the toner T, even when the amount of the remaining toner T is small, the toner T resides in the optical path and cuts off the light beam, whereby it can be detected that the toner remains.

In the above embodiment, the reflection mirror 34*c* is external to the detection window 36*b* of the toner cartridge 33. It can be placed on the inner surface of the container of the toner cartridge 33.

The first to sixth embodiments of the present invention have been described above. In these embodiments, the detection windows formed in the toner cartridge are provided with a member made from a transparent or semi-transparent light transmitting material. The whole toner cartridge as a container or the whole side wall in which the detection windows are formed may be made from a transparent or semi-transparent light transmitting material.

Not describing in the second to sixth embodiments, a flexible member made of a synthetic resin piece may be provided near the exhaust port of the toner cartridge and moved by the rotation of the rotary shaft or stirring blade to destroy the toner T residing near the exhaust port in order to prevent the toner T from crosslinking or residing as described in the first embodiment.

Further, in the above first to sixth embodiments, the light projecting unit and the light receiving unit of the toner detector are arranged in the developing unit. The light projecting unit and the light receiving unit may be arranged on the side wall of the toner cartridge. In this constitution, terminals for connecting the light projecting unit and the light receiving unit to the controller of the toner detector when the toner cartridge is mounted to the developing unit are provided in the toner cartridge.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A toner cartridge comprising:

a developer storage container for storing a developer;

a rotary conveyance body, installed in said developer storage container, for carrying the developer in the developer storage container toward an exhaust port; and detection windows through which a light beam projected from a developer detector is input and output to detect the remaining state of the developer in the toner cartridge when the toner cartridge is mounted to a developing unit, wherein said detection windows are arranged at positions where the optical axis of the input and output light beam intersects the rotary shaft of said rotary conveyance body obliquely on a projection plane when seen from the top or side of the toner cartridge.

2. The toner cartridge according to claim 1, wherein said detection windows are arranged such that the optical axis of the input and output light beam becomes parallel to a direction that said rotary conveyance body carries the developer.

3. The toner cartridge according to claim 1 which can be attached to and detached from the developing unit.

4. The toner cartridge according to claim 1 which is integrated with the developing unit.

5. The toner cartridge according to claim 1, wherein said detection windows are located at positions where the optical axis of a light beam input and output through the detection windows passes over the developer exhaust port.

6. The toner cartridge according to claim 1 which can be attached to and detached from an image forming apparatus.

7. The toner cartridge according to claim 1, wherein the intersection angle between the optical axis of said light beam and the rotary shaft of said rotary conveyance body is in the range of about ±30° of an angle θ calculated from the following expression:

$$\tan\theta = (\text{diameter of rotary conveyance body})/(\text{length of rotary shaft}).$$

8. The toner cartridge according to claim 1, wherein the developer detector for projecting and receiving said light beam is provided in the developing unit.

9. The toner cartridge according to claim 1, wherein the developer detector for projecting and receiving said light beam is provided in an image forming apparatus.

10. A toner cartridge comprising:

a developer storage container for storing a developer;

a rotary conveyance body, arranged in said developer storage container, for carrying a developer in the storage container toward an exhaust port; and detection windows through which a light beam projected from a developer detector is input and output to detect the remaining state of the developer in the toner cartridge when the toner cartridge is mounted to a developing unit, wherein said detection windows are arranged such that the optical axis of the input and output light beam becomes parallel to a direction that said rotary conveyance body carries the developer.

11. The toner cartridge according to claim 10 which can be attached to and detached from the developing unit.

12. The toner cartridge according to claim 10 which is integrated with the developing unit.

13. The toner cartridge according to claim 10, wherein said detection windows are located at positions where the optical axis of a light beam input and output through the detection windows passes over the developer exhaust port.

14. The toner cartridge according to claim 10 which can be attached to and detached from an image forming apparatus.

15. An image forming apparatus comprising:

a toner cartridge for storing a developer, which comprises a rotary conveyance body for carrying the stored developer toward an exhaust port;

an image carrier having a latent image formed thereon and holding a developer image developed with the developer;

a developing unit for developing the latent image formed on the surface of the image carrier; and a developer detector having a light beam projecting unit and a light beam receiving unit to detect the remaining state of the developer in said toner cartridge, wherein said toner cartridge has detection windows through which a light beam projected from said developer detector is input and output when the toner cartridge is mounted to the developing unit; and said detection windows are arranged at positions where the optical axis of the input and output light beam intersects the rotary shaft of said rotary conveyance body obliquely on a projection plane when seen from the top or side of the toner cartridge.

16. The image forming apparatus according to claim 15, wherein the detection windows of said toner cartridge are arranged such that the optical axis of the input and output light beam becomes parallel to a direction that said rotary conveyance body carries the developer.

17. The image forming apparatus according to claim 15, wherein the detection windows of said toner cartridge are arranged at positions where the optical axis of a light beam input and output through the detection windows passes over the developer exhaust port.

18. The image forming apparatus according to claim 15, wherein said toner cartridge can be attached to and detached from the image forming apparatus.

19. An image forming apparatus comprising:

a toner cartridge for storing a developer, which comprises a rotary conveyance body for carrying the stored developer toward an exhaust port;

an image carrier having a latent image formed on the surface and holding a developer image developed with the developer:

a developing unit for developing the latent image formed on the surface of the image carrier; and a developer detector having a light beam projecting unit and a light beam receiving unit, for detecting the remaining state of the developer in said toner cartridge, wherein said toner cartridge has detection windows through which a light beam projected from said developer detector is input and output when the toner cartridge is mounted to the developing unit; and said detection windows are arranged such that the optical axis of the input and output light beam becomes parallel to a direction that said rotary conveyance body carries the developer on a projection plane when seen from the top or side of the toner cartridge.

20. The image forming apparatus according to claim 19, wherein the detection windows of said toner cartridge are arranged at positions where the optical axis of the input and output light beam passes over the developer exhaust port.

21. The image forming apparatus according to claim 19, wherein said toner cartridge can be attached to and detached from the image forming apparatus.

* * * * *